US006578326B1

(12) United States Patent
Dyrby et al.

(10) Patent No.: US 6,578,326 B1
(45) Date of Patent: Jun. 17, 2003

(54) WINDOW WITH A REDUCED RISK OF CONDENSATION

(75) Inventors: Erik Bjørn Dyrby, Farum (DK); Klaus Kornerup, Birkerød (DK)

(73) Assignee: VKR Holding A/S, Søborg (DE)

( * ) Notice: Subject to any disclaimer, the term of this patent is extended or adjusted under 35 U.S.C. 154(b) by 0 days.

(21) Appl. No.: 09/297,047

(22) PCT Filed: Nov. 14, 1997

(86) PCT No.: PCT/DK97/00519

§ 371 (c)(1),
(2), (4) Date: Apr. 28, 1999

(87) PCT Pub. No.: WO98/22683

PCT Pub. Date: May 28, 1998

(30) Foreign Application Priority Data

Nov. 19, 1996 (DK) ..... 1319/96

(51) Int. Cl.[7] ..... E04B 7/18; E04B 7/00

(52) U.S. Cl. ..... 52/200; 52/408; 52/72; 52/171.2

(58) Field of Search ..... 52/200, 72, 408, 52/171.2

(56) References Cited

U.S. PATENT DOCUMENTS 3,934,383 A * 1/1976 Perry et al. ..... 52/200
4,013,804 A * 3/1977 Gruetzman ..... 427/33
4,073,097 A * 2/1978 Jentoft ..... 52/200
4,439,962 A * 4/1984 Jentoft et al. ..... 52/200
5,355,644 A * 10/1994 Guhl et al. ..... 52/200

FOREIGN PATENT DOCUMENTS

| | | | |
|---|---|---|---|
| DE | 37 05 777 | A1 | 9/1988 |
| DE | 38 02 077 | A1 | 6/1989 |
| DE | 195 17 212 | A1 | 11/1996 |
| EP | 0 251 804 | A1 | 1/1988 |
| GB | 2 094 382 | A | 9/1982 |

* cited by examiner

*Primary Examiner*—Jose V. Chen
*Assistant Examiner*—Phi Dieu Tran A
(74) *Attorney, Agent, or Firm*—Venable; John P. Shannon; Chad C. Anderson

(57) ABSTRACT

A window, in particular for mounting in an inclined roof surface, comprising a frame structure and a relative thereto openable sash structure with an insulating pane (6), the frame and the sash structures comprising top, bottom and side members (21–24) in the form of solid profiles which are for the major part made from a thermally well insulating material. For providing a good heat-transmission from the interior side of the sash structure to border areas of the insulating pane a passive heat bridge has been established at least in the areas (30, 31) around the corners of the sash bottom member (21) and the adjacent side members (24), said heat bridge being of a well heat-conducting material and established in connection with or through said bottom and side members (23, 24) of the sash structure.

10 Claims, 2 Drawing Sheets

WINDOW WITH A REDUCED RISK OF CONDENSATION

BACKGROUND OF THE INVENTION

The present invention relates to a window, in particular for mounting in an inclined roof surface, comprising a frame structure and a sash structure with an insulating pane and is openable relative to the frame structure. The frame and the sash structures comprise profile members, which at least in respect of bottom and side members of the structures, are designed as solid profiles of a thermally well insulating material. A heating means is provided at least in the areas around each of the corners between the sash bottom member and the adjacent side members for preventing condensation on the adjacent corner areas of the insulating pane.

Roof windows having frame and sash structures of solid wood profiles are known, for example, from EP-A-0 251 804 and DE-A-37 05 777.

Many windows having insulating panes, in particular roof windows for mounting in inclined roof surfaces, suffer from the problem that during the cold part of the year, condensation frequently occurs on the interior side of the insulating pane, most often in the corner areas of the pane and with a distinct concentration in corner areas at the corners between the bottom member of the sash structure and the adjacent side members.

To obviate this problem it is known from GB-A-2,094, 382 and DE-A-38 02 077 to place an active heat source in the form of a heater cable or strip at the corner areas in question.

In respect to windows with frame and sash structures made from hollow profiles, it is likewise known from DE-A-195 17 212 to provide a heating means in such corner areas in the form of a heat bridge arranged in the hollow space of the sash member profiles on the interior side of a profile wall facing the light admitting area.

SUMMARY OF THE INVENTION

In the light of this prior art, the object of the invention is to effectively prevent condensation in windows of the above-mentioned type having frame and sash structure made of solid profiles.

To meet this object a window according to the invention is characterized in that the heating means is established as a passive heat bridge of a well heat-conducting material integrated in a cover member arranged on the interior side facing the insulating pane of each of the parts of the bottom and side members of the sash structure bordering the corner area in question for providing a good heat-transmission from the interior side of the sash structure to said corner areas of the insulating pane.

By establishing such a heat bridge, which is possible with comparatively simple means, it is possible to eliminate or at least strongly reduce the tendency of condensation in those areas.

In a preferred embodiment in which said heat bridge is established in connection with or through the bottom and side members of the frame structure, measurements have thus confirmed that at an outdoor temperature of 0° and a room temperature of 20°, it is possible to raise the temperature at the interior side of the insulating pane in said areas from approx. 10° to approx. 16°, whereby the risk of condensation at normal degrees of humidity of the atmosphere is eliminated or considerably reduced.

BRIEF DESCRIPTION OF DRAWINGS

The invention will be explained in detail in the following with reference to the schematic drawings, in which FIGS. 1 and 2, partially in sectional views, show two different embodiments of a part of a window according to the invention.

DETAILED DESCRIPTION OF THE PREFERRED EMBODIMENT

Figure 1:
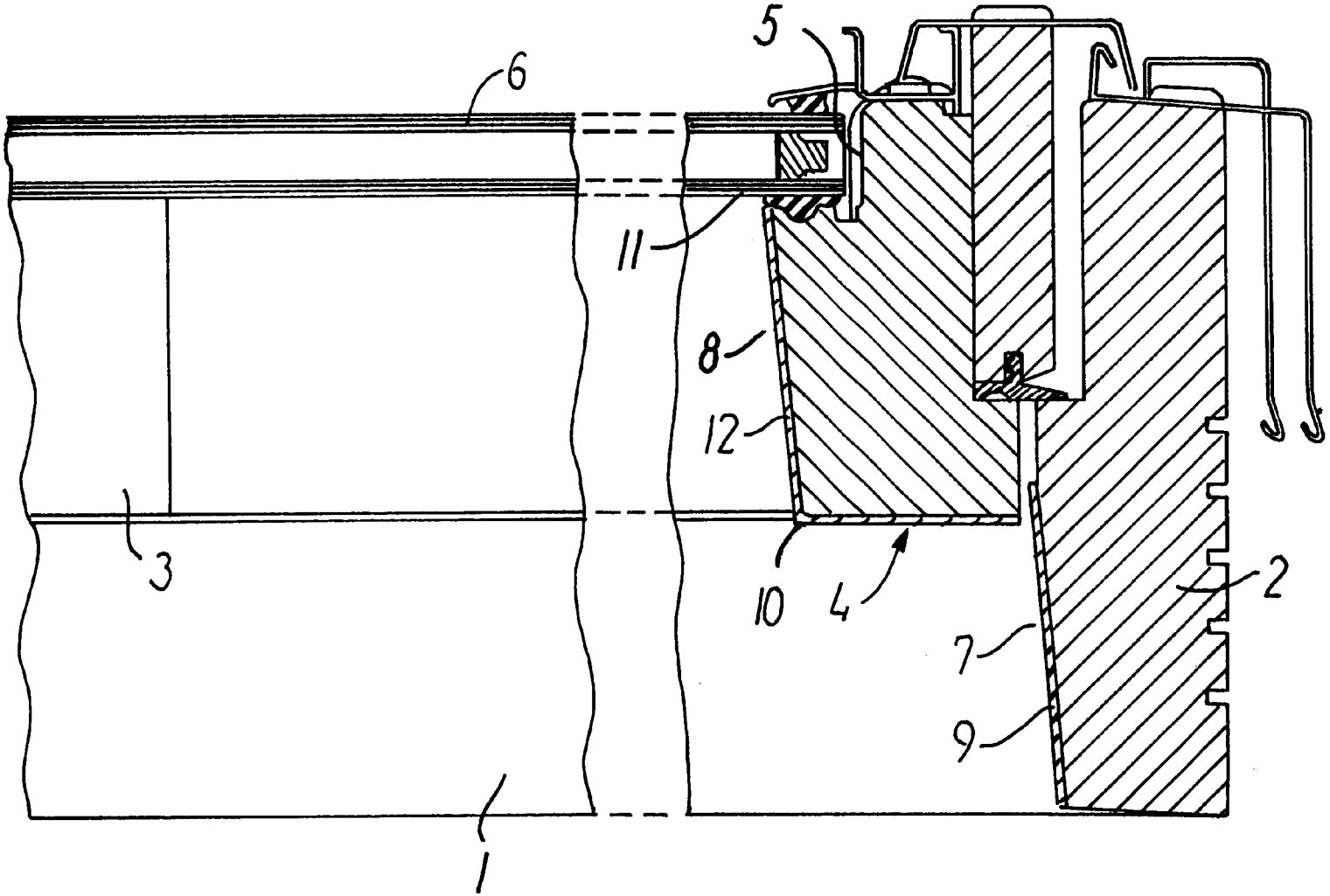

The drawings generally show embodiments of the window according to the invention in the form of a pivoting window or a top-hung window for mounting as a roof window in an inclined roof surface. It will, however, straight away be realized that the invention can also be used for removing or reducing condensation in many other window types.

In both figures, a frame structure is shown with a bottom member 1 and 21, respectively, and one of the adjacent side members 2 and 22, respectively, and a sash structure with bottom member 3 and 23, respectively, and an adjacent side member 4 and 34, respectively. In an exterior rebate 5 in the sash structure, an insulating pane 6 is secured, in the examples shown, with two layers of pane. For this securing, known means are used in the form of packing members and an exterior glazing profile which are of no importance for the invention.

In FIG. 1 the bottom and side members 1–4 of the frame and sash structures are made completely as wood profiles, which in the parts of the bottom and side members 1–4 bordering the corners 7 and 8 as well as the opposite corners in the frame and sash structures, are cladded on the interior sides by metal sheet members 9 and 10, which in the embodiment shown together establish a heat bridge from the interior side of the frame structure towards corner areas 11 on the interior side of the insulating pane 6.

Metal sheet members 9 and 10, which moreover can function as corner reinforcements, may typically extend from the corner 7 or 8 along a part of the bottom members 1, 3 and the side members 2, 4, respectively, with a length of, for instance, 150 mm. If it is preferred, for instance, from aesthetic reason, there is no reason why the cladding members, as shown by 9 and 10, may not extend over the whole length of the bottom and side members 1–4. For removal or reduction of condensation, it will, however, normally be sufficient to place such cladding members at said corner areas.

To prevent moisture from accumulating on the exterior sides, the members may be open for diffusion, and they may, to reduce the risk of fungal attack on the sides facing wood parts in the bottom and side members 1–4, be provided with a covering 12 of a fungicidal material in the from of a known fungicide.

Figure 2:
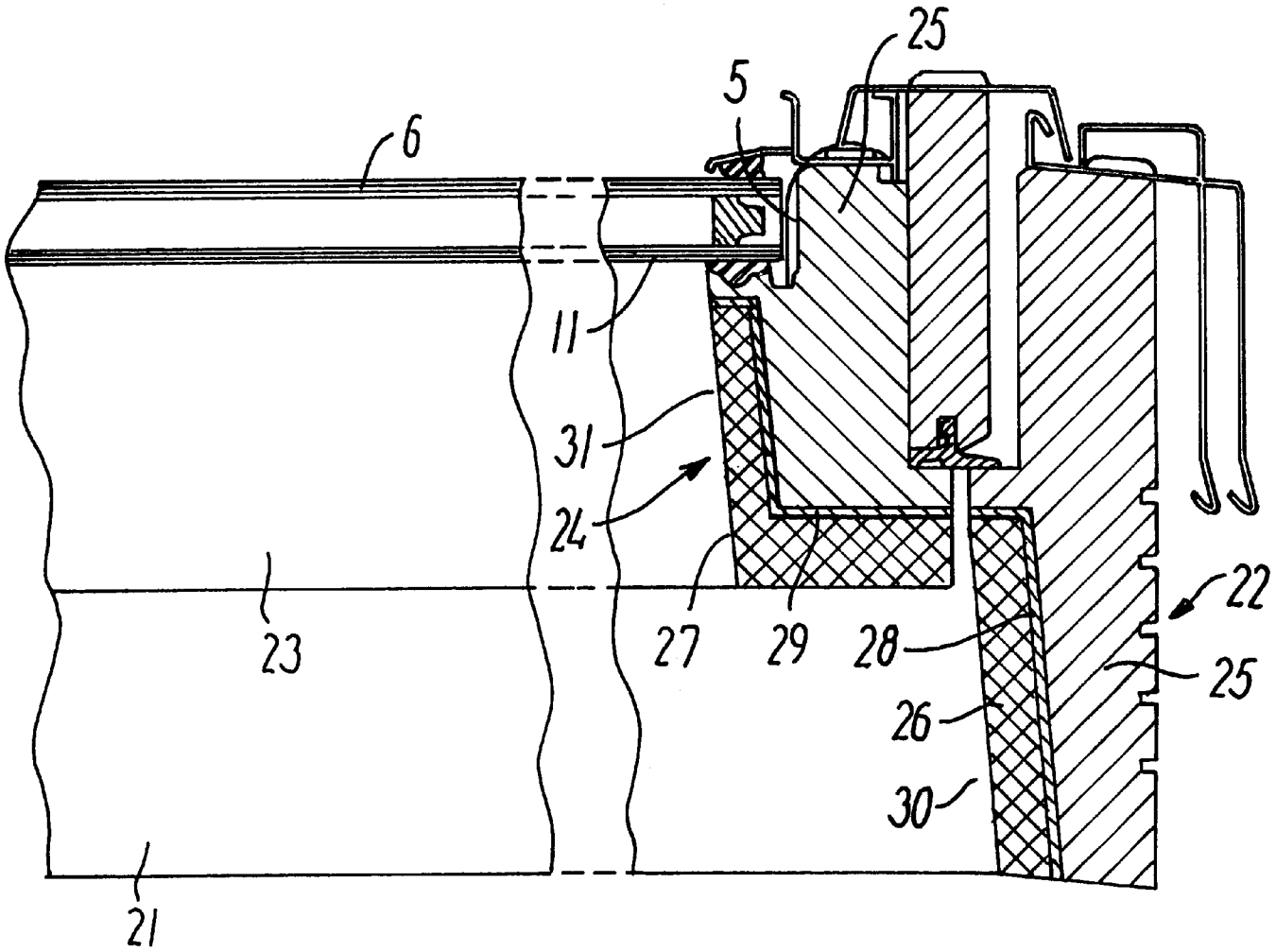

In the embodiment according to FIG. 2, the bottom and side members 21–24 of the frame and sash structures consist, as shown in respect of the side members 22 and 24, or wood profiles 25, on which at the interior side of the profile cross-section cover members 26 and 27 of, for instance, thermoplastic polyurethane (PUR) have been provided with a view to obtaining a special construction, for instance as mentioned in EP 0251804.

In this case, a heat bridge is established from the interior side of the frame structure to the corner area 11 at the interior side of the insulating pane 6 by means of insertion members 28 and 29, respectively, through the parts of the bottom and side members 21–24 bordering the corners 30 and 31. Such insertion members, which have the advantage that the heat transmission to the insulating pane is not subjected to any thermal loss to the surroundings, may, like the cladding members 9 and 10 in FIG. 1, be made as metal sheet members, but in this case, preferably in the form of perforated sheet material, for instance, aluminum.

The insertion members 28 and 29 may, as shown in FIG. 2, be accommodated between the cover members 26, 27 and the wood profiles 25, but they may also advantageously be embedded directly in the cover members 26 and 27.

Likewise, such insertion members may be made in other embodiments than in the form of metal sheet members, for instance, non-metallic heat-conducting material like, for instance, certain carbon fiber.

What is claimed is:

1. A window for mounting in an inclined roof surface of a structure with an interior side facing indoors and an exterior side facing outdoors, comprising:

a frame structure and a sash structure with an insulation pane (6), the sash structure being openable relative to the frame structure, and each of said frame structure and said sash structure having a bottom member and side members, the bottom member and each of the side members intersecting at a corner;

the frame and the sash structures comprising profile members, which, at least with respect to said bottom members and said side members (1–4, 21–24) of the frame and sash structures, are solid profiles of a thermally well insulating material;

heating means in at least corner areas around each of the corners (8, 31) between the sash bottom member and the adjacent side members (4, 24) for preventing condensation on adjacent corner areas of the insulation pane, wherein the heating means is a passive heat bridge of a good heat-conducting material integrated in a cover member (10, 27) arranged on the interior side of the window on each of the bottom and side members (3, 4; 23, 24) of the sash structure facing the insulating pane and bordering said corner areas for providing a good heat-transmission from the interior side of the sash structure to said corner areas (8) of the insulating pane (6).

2. A window according to claim 1, wherein said heat bridge is extended towards the interior side of the frame structure by means of a corresponding heat bridge integrated in cover members positioned on the interior side of the window, on the bottom and side members (1, 2; 21, 22) of the frame structure.

3. A window according to claim 1, wherein said cover member is a heat bridge in the form of a cladding member (9, 10) of metal sheet for cladding said interior sides of the bottom and side members (1–4).

4. A window according to claim 1, wherein said bottom and side members are wood profiles, said cover member comprises a cladding member of thermally insulating plastic material (26, 27) arranged on said interior side of the bottom and side members of at least one of the sash structure and the frame structure, and said heat bridge is integrated in the form of an insertion member (28, 29) of a good heat-conducting material.

5. A window according to claim 4, wherein said insertion member (28, 29) comprises a metal sheet member.

6. A window according to claim 5, wherein said metal sheet member (9, 10; 28, 29) is made from a perforated metal sheet.

7. A window according to claim 5, wherein said metal sheet member (28, 29) is inserted between the cover member (26, 27) and wooden parts (25) of the at least one of the sash profile member and the frame profile member.

8. A window according to claim 5, wherein said metal sheet member is embedded in the cover member.

9. A window according to claim 5, wherein said metal sheet member is a corner reinforcement which, from the corner between bottom member and one of the side members, extends over a part of the length of each of the bottom member and the side member.

10. A window according to claim 5, wherein the sash and frame profiles at least partially are made from wood, and said metal sheet member has places which are in contact with the wood members of the sash and frame profiles, said places being covered by a fungicide material (12).

* * * * *